US009138767B2

(12) United States Patent
Franks et al.

(10) Patent No.: US 9,138,767 B2
(45) Date of Patent: Sep. 22, 2015

(54) SPRINKLER DEVICE WITH FLOW SHUT OFF VALVE

(75) Inventors: Kevin Michael Franks, Perris, CA (US); Donnie Russell Fisher, Cathedral City, CA (US); Brian John Smith, Aliso Viejo, CA (US)

(73) Assignee: Signature Control Systems, Inc., Irvine, CA (US)

( * ) Notice: Subject to any disclaimer, the term of this patent is extended or adjusted under 35 U.S.C. 154(b) by 534 days.

(21) Appl. No.: 12/923,293

(22) Filed: Sep. 14, 2010

(65) Prior Publication Data

US 2011/0068195 A1 Mar. 24, 2011

Related U.S. Application Data

(60) Provisional application No. 61/272,440, filed on Sep. 24, 2009.

(51) Int. Cl.

| | |
|---|---|
| ***B05B 15/10*** | (2006.01) |
| ***B05B 1/30*** | (2006.01) |
| ***B05B 15/00*** | (2006.01) |

(52) U.S. Cl.

CPC ..... *B05B 15/10* (2013.01); *B05B 1/3006* (2013.01); *B05B 15/008* (2013.01)

(58) Field of Classification Search

CPC ..... B05B 1/3006; B05B 15/10; B05B 15/008

USPC ..... 239/204–206, 569–572, 579

See application file for complete search history.

(56) References Cited

U.S. PATENT DOCUMENTS

| | | | | |
|---|---|---|---|---|
| 4,562,962 | A | 1/1986 | Hartman | |
| 5,335,857 | A | 8/1994 | Hagon | |
| 6,000,632 | A | 12/1999 | Wallace | |
| 6,179,221 | B1 | 1/2001 | Goldberg et al. | |
| 6,263,912 | B1 * | 7/2001 | Brown et al. | 137/519.5 |
| 2003/0019950 | A1 | 1/2003 | Veazie | |

OTHER PUBLICATIONS

International Search Report and Written Opinion of the International Searching Authority mailed Nov. 5, 2010 issued in the corresponding PCT international application No. PCT/US2010/049809.

(Continued)

*Primary Examiner* — Jason Boeckmann

(74) *Attorney, Agent, or Firm* — Posz Law Group, PLC

(57) ABSTRACT

A sprinkler for producing a fixed spray pattern includes an inner flow conduit having a nozzle at an outlet. A filter screen is held in place beneath the nozzle. The filter screen engages a push rod of a valve of a flow stop mechanism. The push rod spaces a valve member away from a valve seat to permit water flow through the inner flow conduit when the filter screen and nozzle are in place. If the nozzle is removed or if the inner conduit is severed, the filter screen can be removed, which causes the valve member to close under the force of water pressure and to shut off flow through the inner flow conduit. The valve is located upstream of parts that are vulnerable to damage.

19 Claims, 18 Drawing Sheets

(56) References Cited

OTHER PUBLICATIONS

Notification Concerning Transmittal of International Preliminary Report on Patentability mailed Apr. 5, 2012 and International Preliminary Report on Patentability issued by the International Bureau of WIPO on Mar. 27, 2012 in the corresponding PCT international application No. PCT/US2010/049809.

Chinese Notice of First Office Action dated May 5, 2014 issued from the State Intellectual Property Office of the Peoples' Republic of China in the corresponding Chinese Patent Application No. 201080044118.4 (with English translation).

* cited by examiner

SPRINKLER DEVICE WITH FLOW SHUT OFF VALVE

BACKGROUND

This invention relates to fixed spray sprinklers having a flow shut off valve.

Fixed spray sprinklers are well known which comprise a fixed spray nozzle that is threaded onto the top of a flow conduit. Both the nozzle and the conduit are considered "fixed" because they do not rotate about their axes during operation of the sprinkler. The nozzle might be adjustable to vary the spray. However, once the nozzle is initially adjusted to provide a particular spray, that spray covers a particular area of the ground without rotating or moving the spray relative to the ground.

Typically, fixed spray sprinklers are sold without pre-installed nozzles. A flush cap used on the top of the flow conduit in place of a nozzle. The flush cap is used for flushing out dirt and debris from supply lines. Once the sprinkler is installed but before the flush cap is removed, the sprinkler system is pressurized for the first time. The flush cap is designed to let water exit through the cap during this initial pressurization to flush out any debris that may have gotten inside the supply lines. After this initial flush, the flush caps are removed and replaced with nozzles.

FIG. 1 illustrates a conventional pop-up sprinkler device 10 on which a flush cap 12 is installed. The flush cap 12 is attached to an upper end of an inner conduit 14. The inner conduit 14 moves telescopically within a housing conduit 16. The inner conduit 14 and the housing conduit 16 are coaxial. A metal retraction spring 18 holds the inner conduit 14 in a retracted position within the housing conduit 16 when the water supply to the sprinkler device 10 is off. The spring is located between the inner conduit 14 and the housing conduit 18 and is coaxial to the inner conduit 14 and the housing conduit 18. A cap 110 is threaded to an upper end of the housing conduit 16. The cap 110 has a central opening to permit extension of the inner conduit 14. The cap includes a seal member that, among other things, forms a seal against the inner conduit 14. The upper end of the spring 18 engages the cap 110, which provides a fixed surface. The lower end of the spring 18 engages a spring retainer 112, which is axially movable and is fitted to the lower end of the inner conduit 14.

FIG. 2 shows the sprinkler device 10 when a nozzle 22 and filter 24 are installed in place of the flush cap 12. As shown in FIG. 2, the upper end of the housing conduit is located approximately at the ground level. Thus, parts of the sprinkler device 10 that extend above the ground level are subject to damage from lawnmowers, vehicles, vandalism and the like. FIG. 2 includes a dashed line, which indicates the surface of the ground in which the sprinkler device 10 is buried.

When pressurized water enters an inlet 114, water pressure acts against parts such as the inner conduit 14 and nozzle 22 to compress the spring 18 and to extend the inner conduit 14 to the elevated spray position shown in FIG. 2. When the water supply to the inlet 114 is shut off, the inner conduit 14 is retracted by the restoration force of the spring 18, and the nozzle 22 returns to a position such that very little of the nozzle 22 extends above the cap 110. If the inner conduit 14 is broken or ruptured when water pressure is supplied to the inlet 114, there is nothing to stop water from flowing from the inner conduit 14. Thus such damage can waste water and cause flooding.

U.S. Pat. No. 4,562,962 to Hartman discloses a fixed spray sprinkler equipped with a flow shut off valve. The flow shut off valve includes a poppet valve that is normally held open.

If the sprinkler nozzle is broken or removed, the valve closes to prevent water from flowing out through the flow conduit. The valve is located adjacent the bottom of the flow conduit. However, the sprinkler of U.S. Pat. No. 4,562,962 does not retract and is thus subject to damage. Further, there is no indication that the shut off valve of U.S. Pat. No. 4,562,962 functions with a flush cap.

U.S. Pat. No. 6,179,221 to Goldberg et al. discloses a fixed spray sprinkler equipped with a flow shut off valve. However, the shut off valve is relatively high in the flow conduit. Therefore, if the flow conduit is cut or broken at a point at or below the shut off valve, water will flow from the conduit, and the shut off valve will not function.

SUMMARY

Basically, the invention is a sprinkler device including: a housing conduit, which has an inlet at an upstream end and an upper end; an inner conduit fitted in the housing conduit in an axially movable manner so that the inner conduit moves axially to an extended position when a predetermined level of water pressure is applied to the inlet; a valve located at an upstream end of the inner conduit, wherein water pressure from the inlet tends to close the valve; a push rod located within the inner conduit downstream of the valve to operate the valve, wherein an upstream end of the push rod is connected to a valve member of the valve so that axial force by the push rod toward the valve opens the valve; and an insert member located within the inner conduit between a downstream end of the push rod and an outlet of the inner conduit. A downstream end of the insert member engages a fixed member located at the outlet of the inner conduit and the downstream end of the push rod engages an upstream end of the insert member. The lengths of the insert member and the push rod are determined in relation to the length of the inner conduit so that the push rod normally holds the valve in an open position. Severing of the inner conduit permits the push rod to move in a downstream direction, which closes the valve.

In one aspect, the insert member is a filter, and the fixed member located at the outlet of the inner conduit is a nozzle.

The valve remains within the housing conduit when the inner conduit is in the extended position, to protect the valve from damage.

DETAILED DESCRIPTION OF THE PREFERRED EMBODIMENTS

Figure 1:
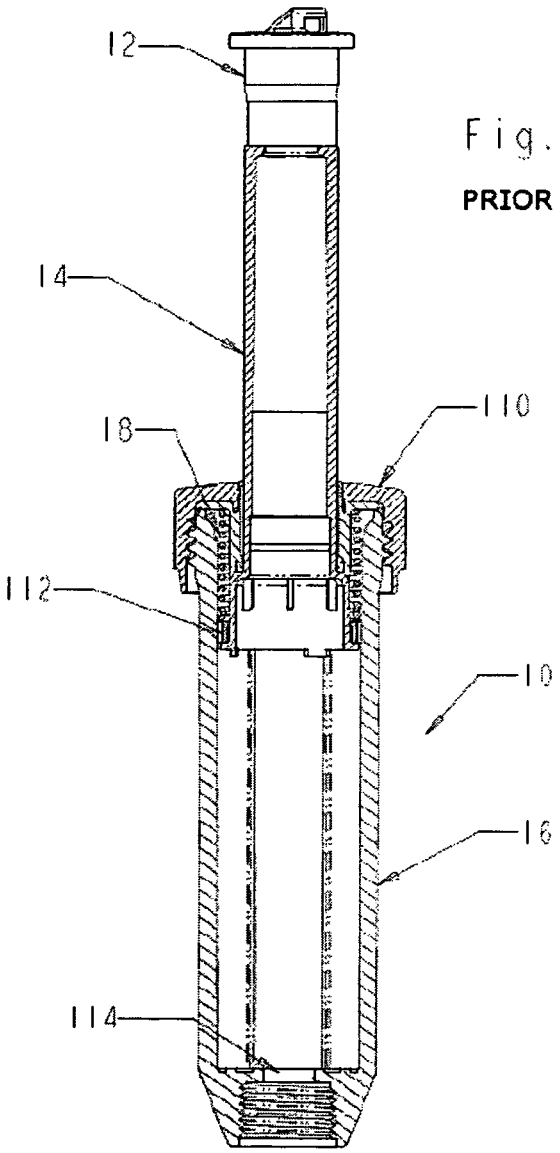
Fig. 1 PRIOR ART
FIG. 1 is a partial cross-sectional view of a prior art sprinkler device with a flush cap installed.
Figure 2:
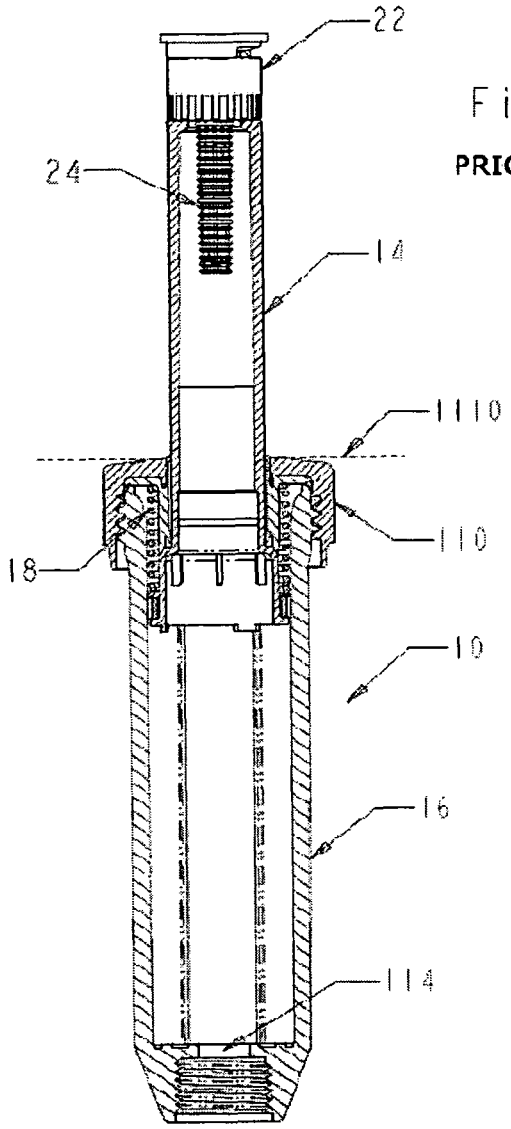
Fig. 2 PRIOR ART
FIG. 2 is a partial cross-sectional view of the prior art sprinkler of FIG. 1 with a nozzle and filter installed.
Figure 4:
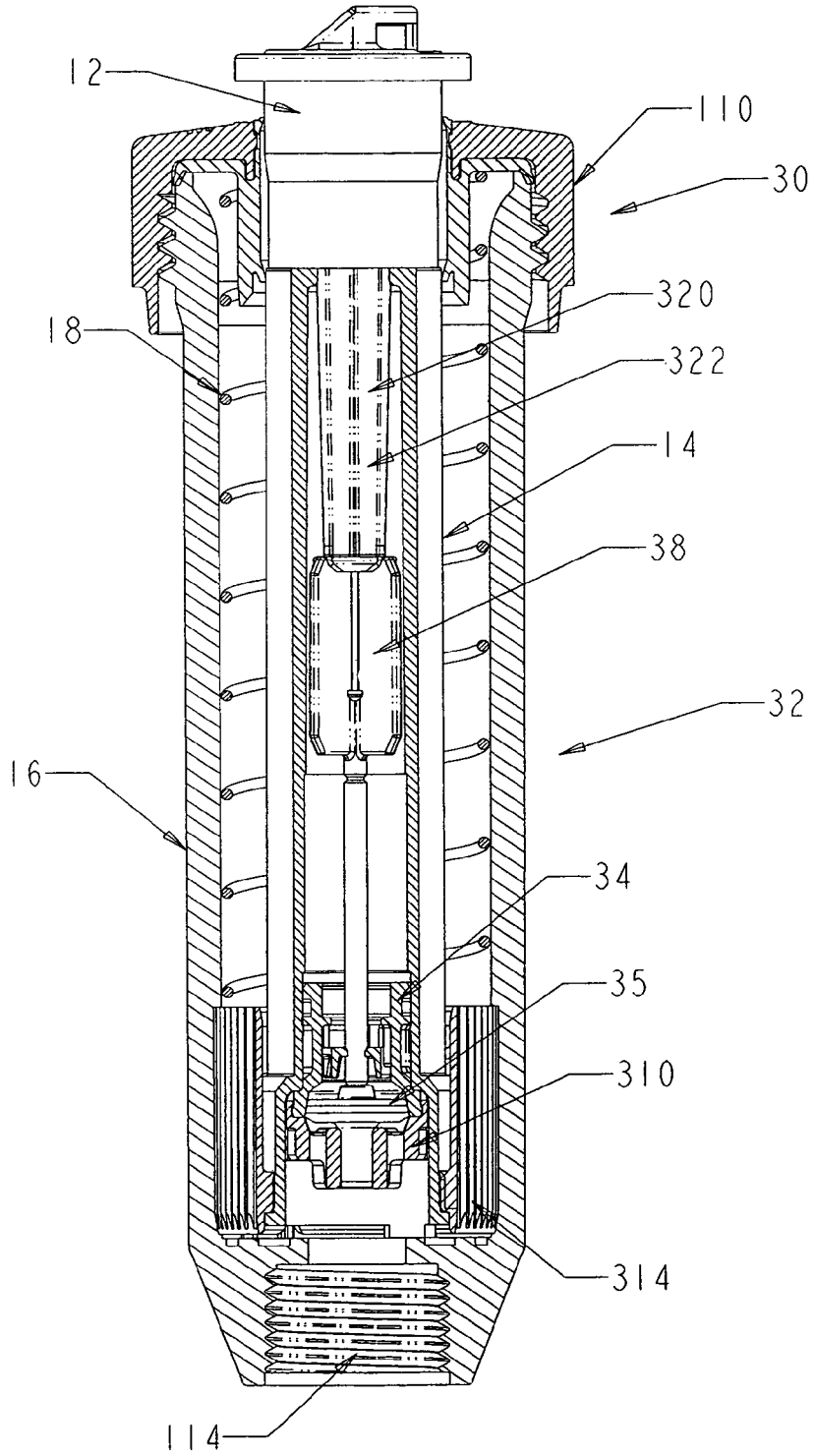
FIG. 4 is a partial cross-sectional view of a retracted sprinkler device in which a flush cap and a flow stop device are installed.

FIG. 4 shows a sprinkler device 30 that includes a flow stop mechanism 32. The sprinkler device 30 includes the same housing conduit 16, inner conduit 14, flush cap 12 and cap 110 that were employed in the conventional sprinkler device 10 of FIGS. 1 and 2; however, the sprinkler device 30 further includes the flow stop mechanism 32. The flow stop mechanism 32 stops the flow of water to the inner conduit 14 when the inner conduit or the nozzle 22 is severed.

The metal spring 18 is held between the cap 110 and a spring retainer 314. The spring retainer 314 is fitted to the lower end of the inner conduit 14 so that the force of the spring 18 is applied to the lower end of the inner conduit 14. Thus, the spring 18 urges the inner conduit 14 to the retracted, or lower, position. When water pressure is applied via the inlet 114 to the inner conduit 14, the spring retainer 314 is forced axially upward against the spring 18 to extend the inner conduit 14. In the absence of a predetermined level of water pressure at the inlet 114, the inner conduit 14 remains in the retracted position.

Figure 5:
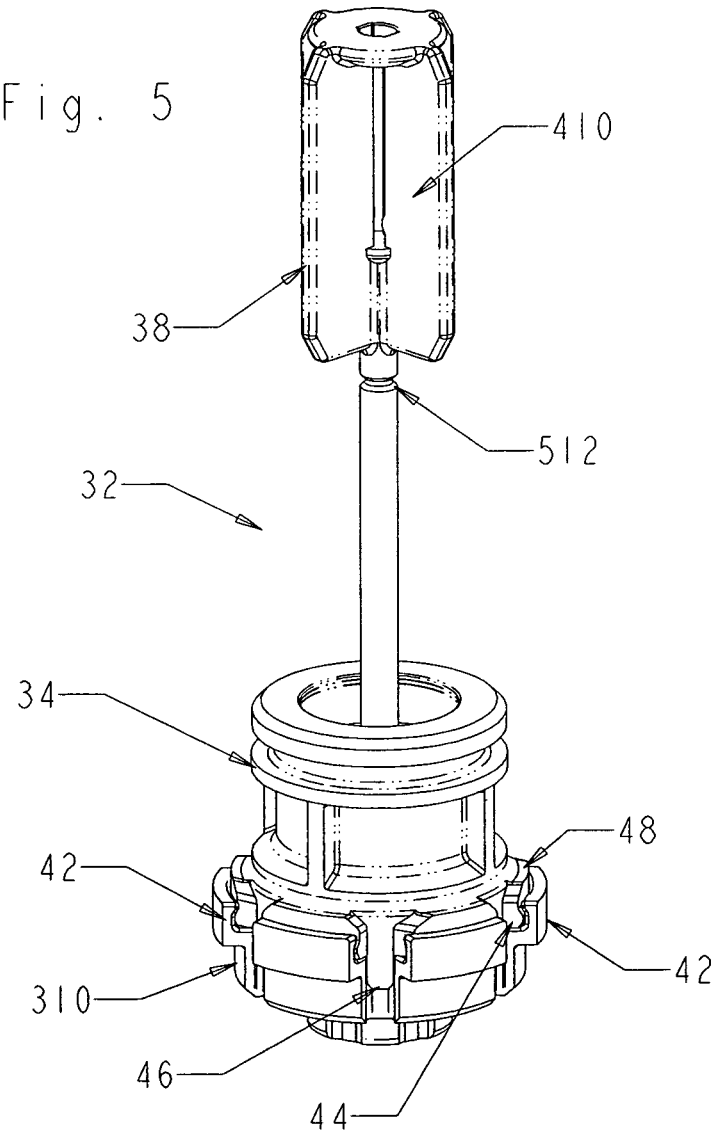
FIG. 5 is a perspective view of the flow stop mechanism of FIG. 4.

As shown in FIGS. 4 and 5, the flow stop mechanism 32 includes a body 34, a valve 35, which includes a valve element 36 and a valve seat 52, a push rod 38, and a lower housing member 310. The lower housing member 310 includes flexible tabs 42. The lower housing member 310 is snap-fitted to the body 34 with the flexible tabs 42, which engage rounded projections 44. The rounded projections are formed at discrete intervals about the lower periphery of the body 34 as shown in FIG. 5. Thus, urging the lower housing member 310 axially toward the body 34 with the proper alignment will fix the lower housing member 310 to the body 34.

The body 34 is designed to work in conjunction with an existing pressure regulator, which is described in connection with FIG. 23.

The lower end of the push rod 38 fits into an opening, or socket, at an upper end of the valve element 36 so that the push rod 38 is coupled to the valve element 36. The push rod 38 is connected to the valve element 36 so that the push rod 38 can hold the valve element in an open position. The push rod 38 is removable from the valve element 36 so that push rods 38 of differing sizes can be used with the same valve element 36. The connection between the lower end of the push rod need not be a secure connection. It is only necessary for the push rod 38 to engage the valve element 36 in order to hold it in an open position.

Figures 16, 17, 18:
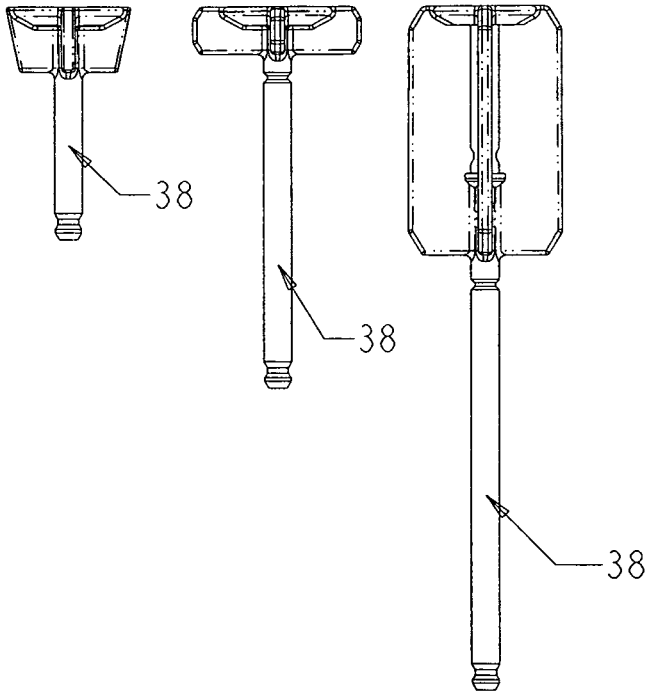
FIGS. 16, 17, and 18 are side views of push rods of various sizes, respectively.

Preferably, there is a "snap fit" coupling between the upstream end of the push rod 38 and down stream end of the valve element 36, so that the push rod 38 and the valve element 36 can be retained together for ease of installation and for manufacturing purposes. However, the "snap fit" coupling can be separated manually for replacement or interchanging of parts. The "snap fit" coupling can be formed by a ball and socket type coupling, for example. In the illustrated embodiment, the upstream end of the push rod is rounded and includes a neck as best shown in FIGS. 16-18. The downstream end of the valve element 36 includes a socket with a detent mechanism for retaining the upstream end of the push rod 38.

Figure 6:
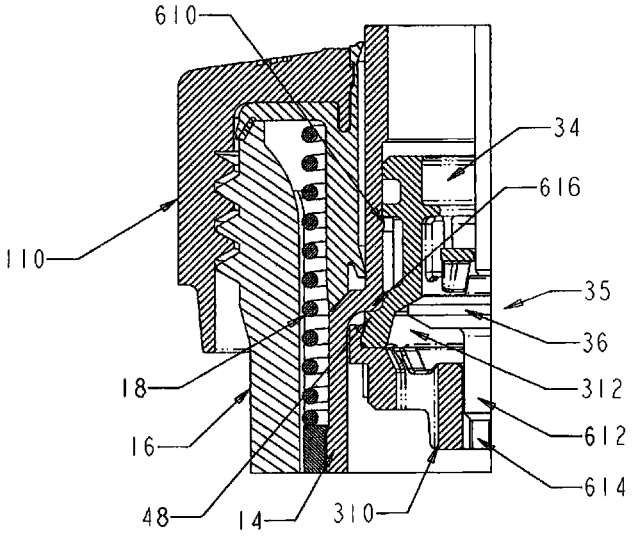
FIG. 6 is an enlarged partial cross sectional view of a section of the sprinkler device of FIG. 4 when the sprinkler device is in an extended, or raised, position.
Figure 8:
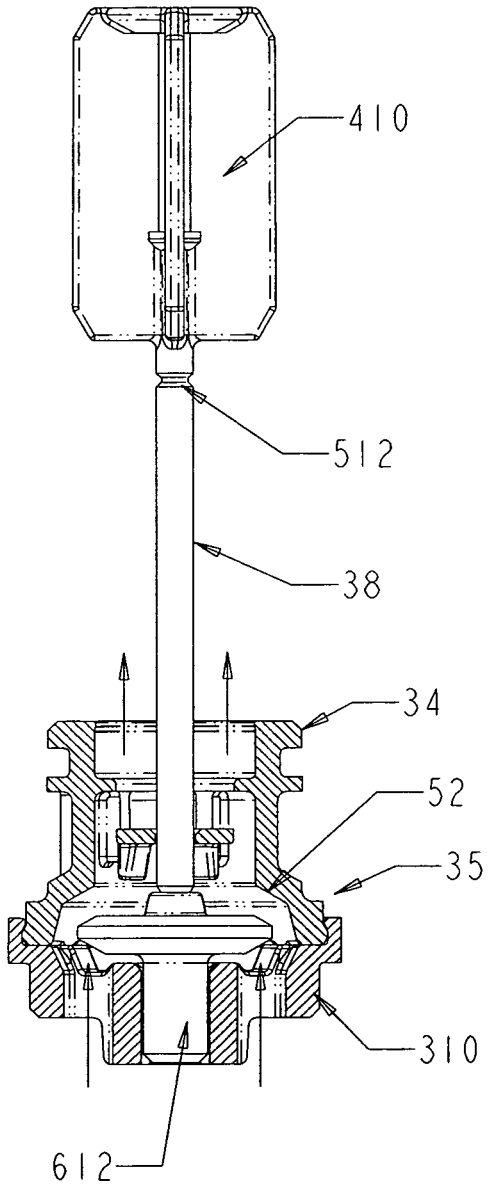
FIG. 8 is a partial cross sectional side view of the flow stop mechanism of FIG. 4 in which the flow stop valve is open.
Figure 9:
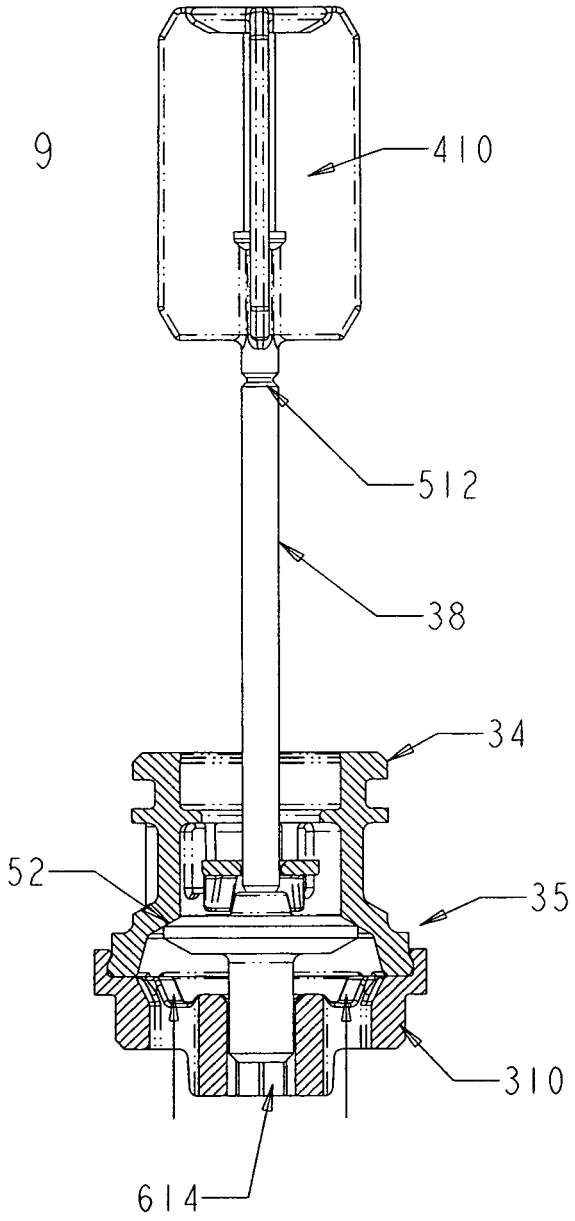
FIG. 9 is a partial cross sectional view of the flow stop mechanism of FIG. 4 in which the flow stop valve is closed.

The body 34 and the lower housing member 310 form a valve chamber 312, which houses the valve 35. The valve seat 52 is formed by an inner surface of the body 34, as shown in FIGS. 6 and 8. When the valve element 36 is in a lower position, as shown in FIG. 8, water can flow freely through the body 34 to the inner conduit 14 and out through the nozzle 22 or flush cap 12. When the valve element 36 is in an upper position, as shown in FIG. 9, water is blocked from flowing through the body 34 by a seal formed between the valve element 36 and the valve seat 52. That is, the valve 35 is closed when the valve element 36 is in its uppermost position and abutted against the valve seat 52.

Normally, water pressure tends to close the valve 35. However, the push rod 38 is stopped from moving axially in an upward direction by an insert member 320, which may be a flush cap insert 322 or the filter element 24. The insert member 320 can be any member that is rigid and permits water flow. In the event that the flush cap 12 is installed, the flush cap insert 322 is installed between the flush cap 12 and the upper end of the push rod 38. The flush cap 12 is fastened by threads to the upper end of the inner conduit 14. Thus, the flush cap 12 is fixed against axial movement. When force is transmitted axially from the valve element 36, as a result of water pressure, to the flush cap insert 322, the flush cap insert 322 is held in position by the flush cap 12 and cannot move axially upward. Thus, the valve 35 remains open and the sprinkler device 30 can function normally.

Similarly, when the nozzle 22 is fastened to the upper end of the inner conduit 14 by, for example, mating threads, the nozzle is fixed against axial movement. When the nozzle 22 is installed, the filter 24 is also installed below the nozzle, in the same manner as in the conventional device shown in FIG. 2. In this state, the filter 24 serves as the insert member and transmits force from the push rod 38 to the nozzle 22. In other words, the filter 24 is rigid, and the upper end of the filter 24 engages the nozzle 22 and the lower end of the filter 24 engages the push rod 38. Thus, when force is transmitted axially from the valve element 36 and the push rod 38, as a result of water pressure, to the filter 24, the filter 24 is held in position by the nozzle 22 and cannot move axially upward. Thus, the valve 35 is prevented from closing and remains open, and the sprinkler device 30 can function normally.

Figure 10:
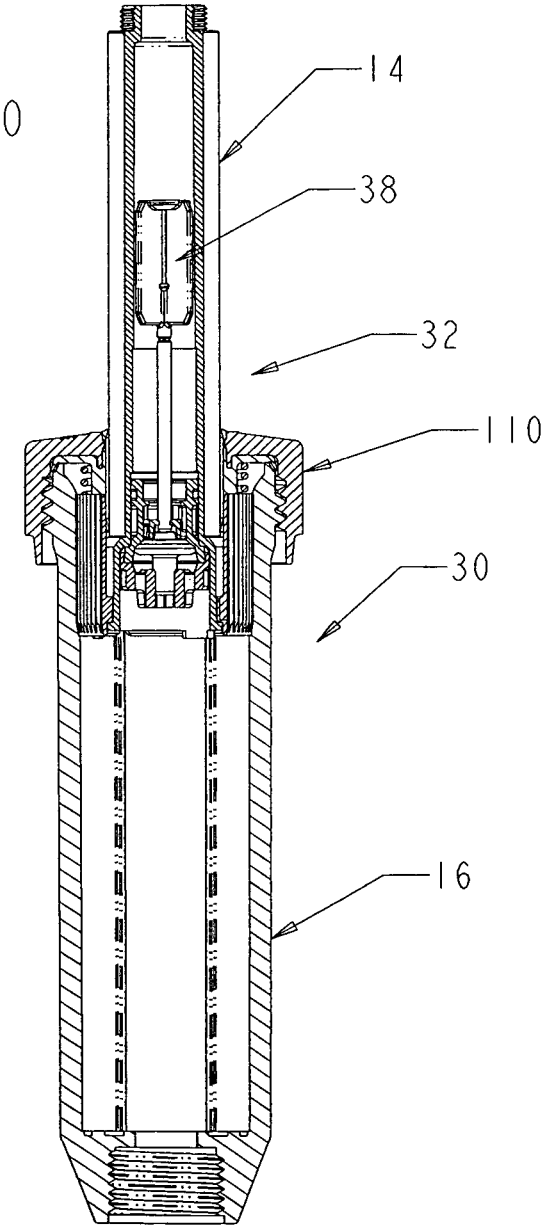
FIG. 10 is a partial cross sectional view of the sprinkler device of FIG. 4 in which the riser is extended, the nozzle is removed, and the flow stop valve is closed.
Figure 11:
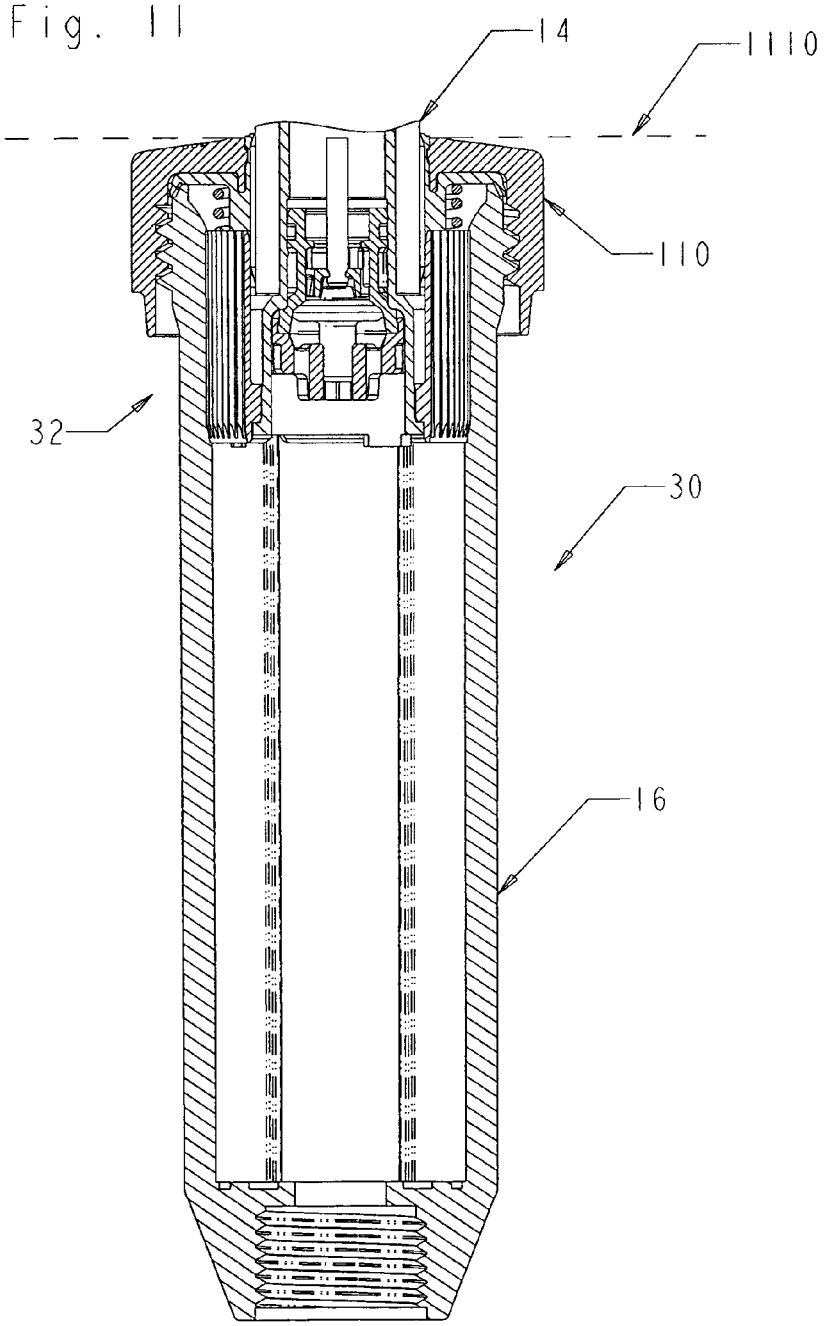
FIG. 11 is a partial cross sectional view of the sprinkler device of FIG. 3 in which parts of the inner conduit and flow stop mechanism have been severed resulting in closure of the flow stop valve.

As shown in FIGS. 10 and 11, in the event of damage to the nozzle 22 or the inner conduit 14, the nozzle 22 will no longer remain fixed with respect to the inner conduit 14. Thus, the push rod 38 will be allowed to move axially upward under the force of water pressure. If the push rod 38 is allowed to move axially upward, the valve 35 will close as a result of water pressure acting on the valve element 36, as illustrated in FIG. 6. Thus, when the nozzle 22 is separated from the inner conduit 14 or if the inner conduit 14 is severed or significantly damaged, the valve 35 is closed, and water cannot flow from the inner conduit 14. This prevents flooding and waste.

As shown in FIG. 5, the push rod 38 includes a plurality of vanes 410. The vanes 410 are angularly spaced apart by ninety degree intervals. The vanes 410 keep push rod 38 centered in the inner conduit 14 and serve to "straighten" the flow of water to reduce turbulence for improved nozzle performance.

The push rod 38 can have an area of weakness 512, which facilitates breakage of the push rod 38 in the event of damage to the inner conduit 14 at any point above the upper surface of the cap 110. That is, a cylindrical section of the push rod 38 includes an area of reduced diameter to provide weakness and to encourage breakage upon the application of unusual force. Breakage of the push rod 38 ensures that the valve 35 will close. However, even without an area of weakness 512, the push rod is relatively thin and is readily broken when subjected to unusual force. Although only one area of weakness 512 is illustrated, multiple areas of weakness 512 can be provided at intervals along the push rod 38.

The body 34 is installed at the lower end of the inner conduit 14, as shown in FIG. 4. As shown in FIGS. 10 and 11, even when the inner conduit is fully extended in the upward axial direction, the body 34 remains below the level of the ground 1110. That is, the body remains below the upper surface of the cap 110. Therefore, the valve 35 is not subject to damage from lawnmowers, vehicles, and the like. Also, the inner conduit 14 is not subject to damage at a point below the body 34, since the body 34 is installed at a point proximal to the upstream end of the inner conduit 14. Therefore, any damage to the inner conduit or nozzle 22 will occur above and downstream of the valve 35. As a result, the flow stop mechanism 32 is more reliable and more effective than a sprinkler device in which a shut off valve is raised above the ground level. Such a valve is vulnerable to damage and is further subject to being rendered ineffective by damage that occurs below and upstream of the valve.

Figure 3:
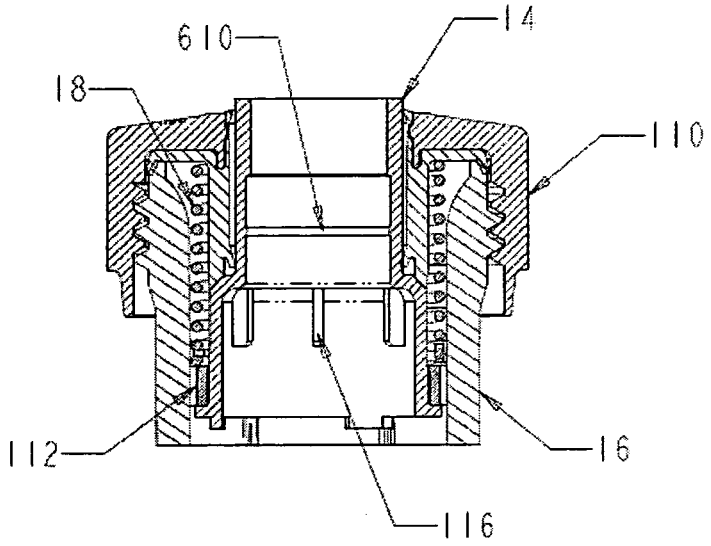
Fig. 3 PRIOR ART
FIG. 3 is an enlarged partial cross-sectional view of the prior art sprinkler of FIG. 1.
Figure 7:
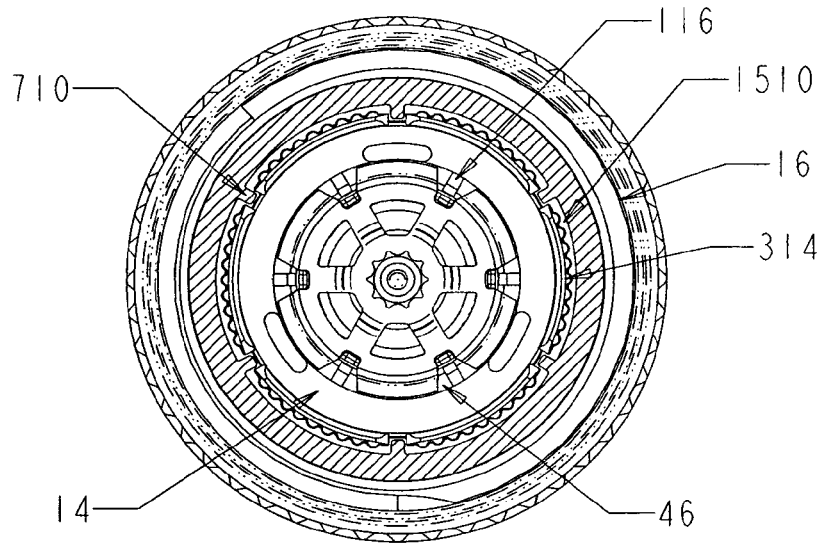
FIG. 7 is a cut away view in a plane normal to the axis of the sprinkler device.

As shown in FIGS. 3 and 7, axially extending ribs 116 are formed on the inner surface of the lower, upstream end of the inner conduit 14 of the conventional sprinkler device 10 at circumferentially spaced intervals. The tabs 42 fit between the ribs 116, and the ribs 116 fit into channels 46, which are formed between the tabs 42 on the lower housing member 310. The outer diameter of the body 34 is sized to mate with the inner surface of the lower end of an existing inner conduit 14 of the existing sprinkler device 10, as shown best in FIG. 6.

Thus, the flow stop mechanism 32 is constructed to be fitted in an existing sprinkler device 10. Further, the flow stop mechanism 32 is modular and is optional. Thus, purchasers can decide whether to have the flow stop mechanism 32 installed, and a sprinkler device 10 without the flow stop mechanism 32 functions normally, but lacks the flow stop feature. Although the flow stop mechanism 32 is modular and optional in the preferred and illustrated embodiments, the flow stop mechanism can be integrated into the sprinkler device 30 so that is not an optional feature.

An annular projection 610 is formed on the inner surface of the inner conduit 14, as shown in FIG. 6. The annular projection 610, which exists in the conventional inner conduit 14, is rounded to provide a detent for resisting downward axial movement of the body 34. Thus, the annular projection serves to retain the body 34 or other modular components in the lower end of the inner conduit 14.

The outer surface of the body 34 is sized to fit tightly against the inner surface of the inner conduit 14 at the lower end of the inner conduit 14. The fit between the body 34 and the inner conduit 14 limits or prevents the passage of water between the outer surface of the body 34 and the inner surface of the inner conduit 14. However, the fit is not a press fit that would prevent movement of the body and prevent installation and removal of the flow stop mechanism 32.

In addition, a shoulder 48 of the valve body 34 abuts against a stepped surface 616 of the inner conduit 14 to prevent upward axial movement of the body 34. Thus, the force of water pressure against the inlet end of the lower housing member 310 does not move the body 34 axially upward beyond a predetermined point.

As shown in FIG. 6, the valve element 36 includes a lower extension 612, which fits in a cylindrical guide 614 that is formed in the lower housing member 310. The lower extension 612 and the cylindrical guide 614 serve to keep the valve element 36 aligned with a center axis of the lower housing member 310 and thus centered with respect to the inner conduit 14. This ensures correct operation of the valve 35.

Figure 12:
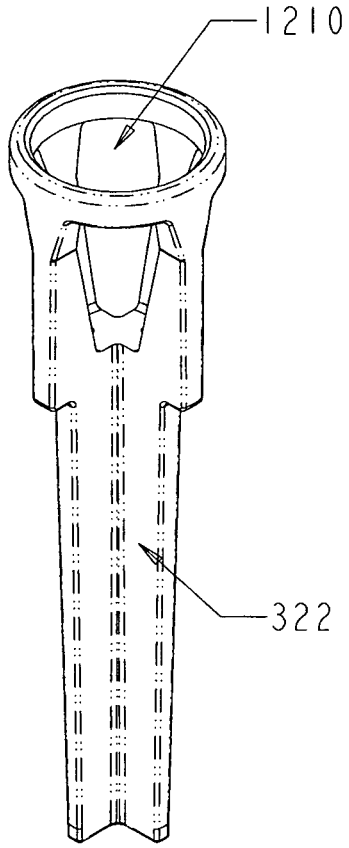
FIG. 12 is a perspective view of a flush cap insert of the sprinkler device of FIG. 4.
Figure 13:
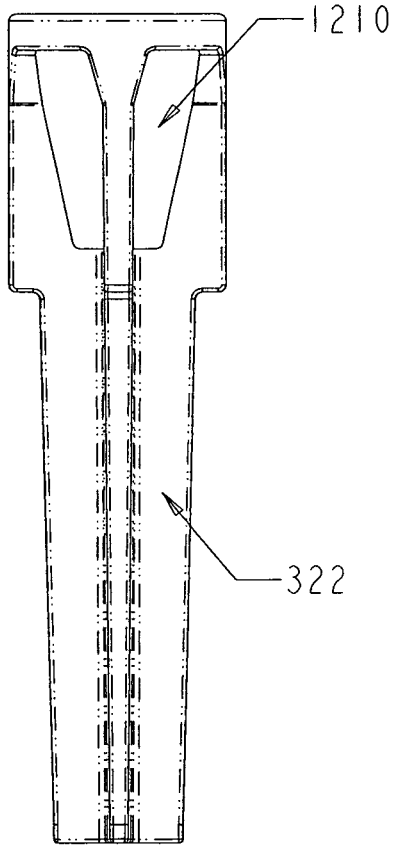
FIG. 13 is a side view of the flush cap insert of FIG. 4.

Figs. 12 and 13 show the flush cap insert 322. Passages 1210 formed in the flush cap insert 322 allow debris to be flushed through the sprinkler device 30 before installation of the nozzle 22 and filter 24. The flush cap insert 322 is preferably made of rigid plastic and is typically discarded along with the flush cap 12 after the initial flushing operation.

Figure 14:
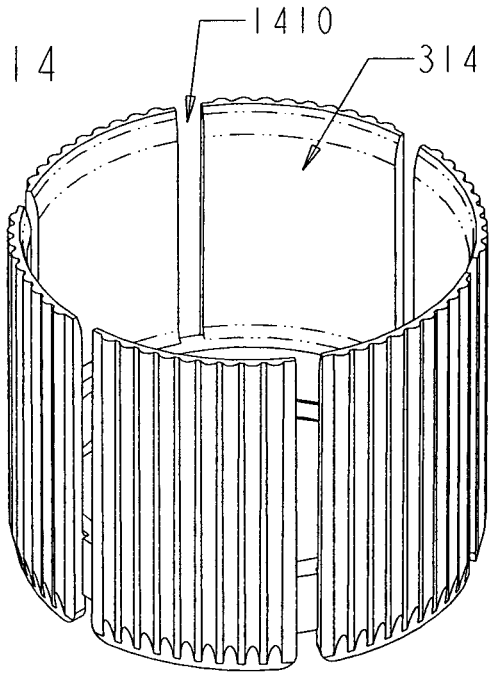
FIG. 14 is a perspective view of a spring retainer of the sprinkler device of FIG. 4.
Figure 15:
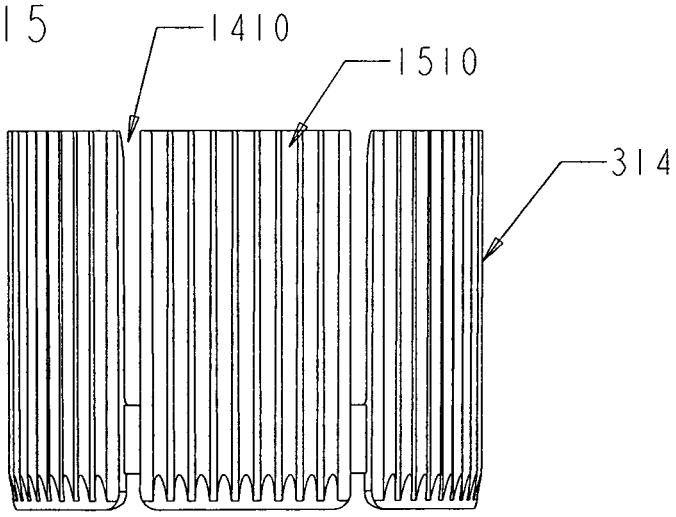
FIG. 15 is a side view of the spring retainer of FIG. 4.

FIGS. 14 and 15 show the spring retainer 314. The retainer 314 provides stable support for the inner conduit 14 in the event of breakage of the inner conduit 14 to ensure that any remaining section of the inner conduit 14 remains centered in the body so that the seals remain intact. The spring retainer 314 includes channels 1410, or slots, into which ribs 710 fit. The ribs 710 are formed in the inner surface of the housing conduit 16, as shown in FIG. 7. Grooves 1510 on the outer surface of the retainer 314 increases resistance to debris. The inner surface of the spring retainer 314 and the outer surface of the inner conduit 14 have an interference fit that allows rotational adjustment of the inner conduit 14 about the longitudinal axis of the sprinkler 30 to adjust the direction of spray of the nozzle 22.

The length of the push rod 38 is determined by the length of the inner conduit 14 and the length of the filter to ensure that the valve 35 is open when the flow stop mechanism is installed in the inner conduit 14 and all parts such as the nozzle 22 are intact. Since parts such as the inner conduit 14 and the filter are manufactured in standard sizes, corresponding standard sizes of the push rod 38 are provided.

Figures 19, 20, 21, 22:
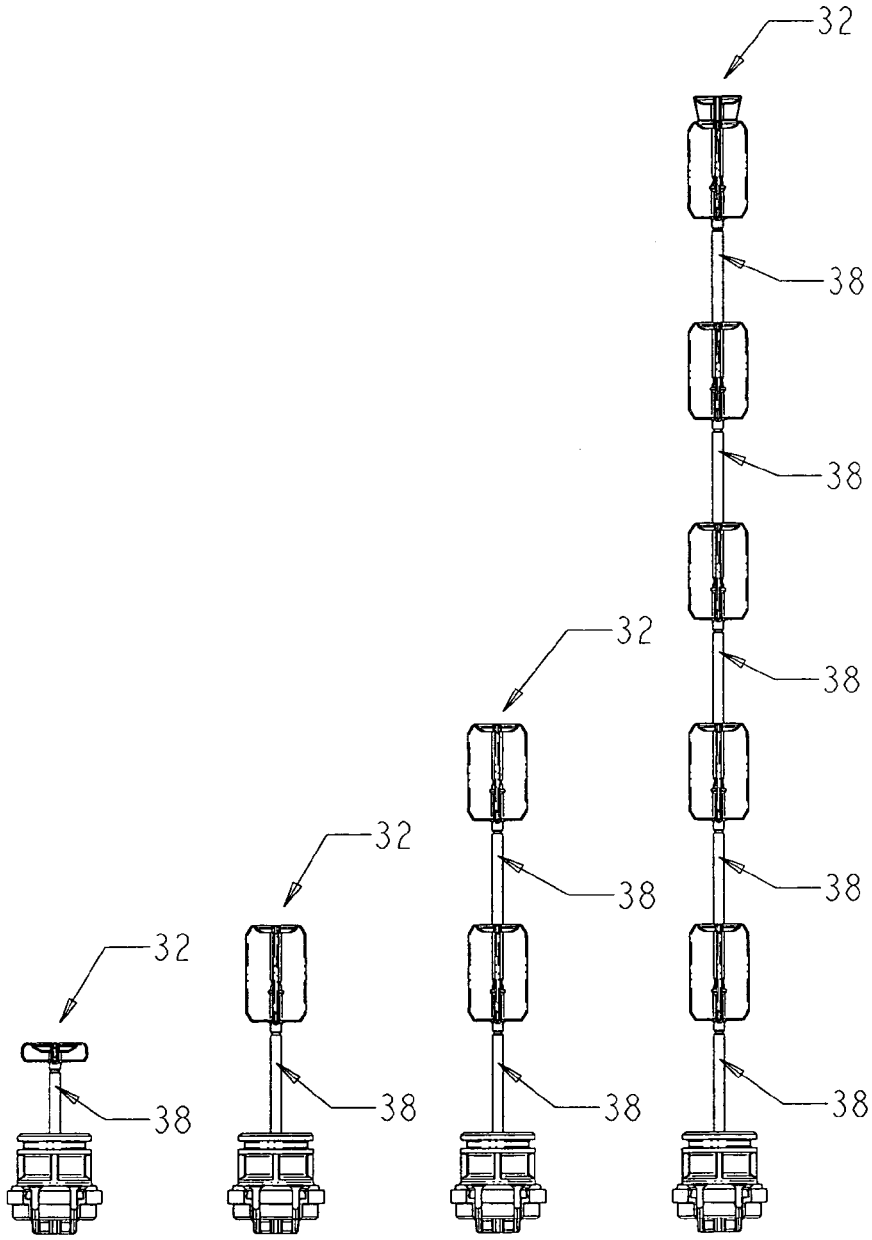
FIGS. 19, 20, 21, and 22 are side views of flow stop mechanisms having push rods of various sizes, respectively.

FIGS. 16-18 show push rods 38 of varying sizes. Since the length of the inner conduit 14 can vary according to the conditions of the installation, push rods 38 of varying length are required. FIGS. 19 and 20 show push rods 38 of varying sizes installed in flow stop mechanisms 32. The upper end of at least the larger of the push rods 38 has an opening, or socket, for receiving a lower end of another push rod 38. Thus, for very long inner conduits 14, several push rods 38 can be interconnected in series to form extended push rod assemblies, as shown in FIGS. 21 and 22.

Figure 23:
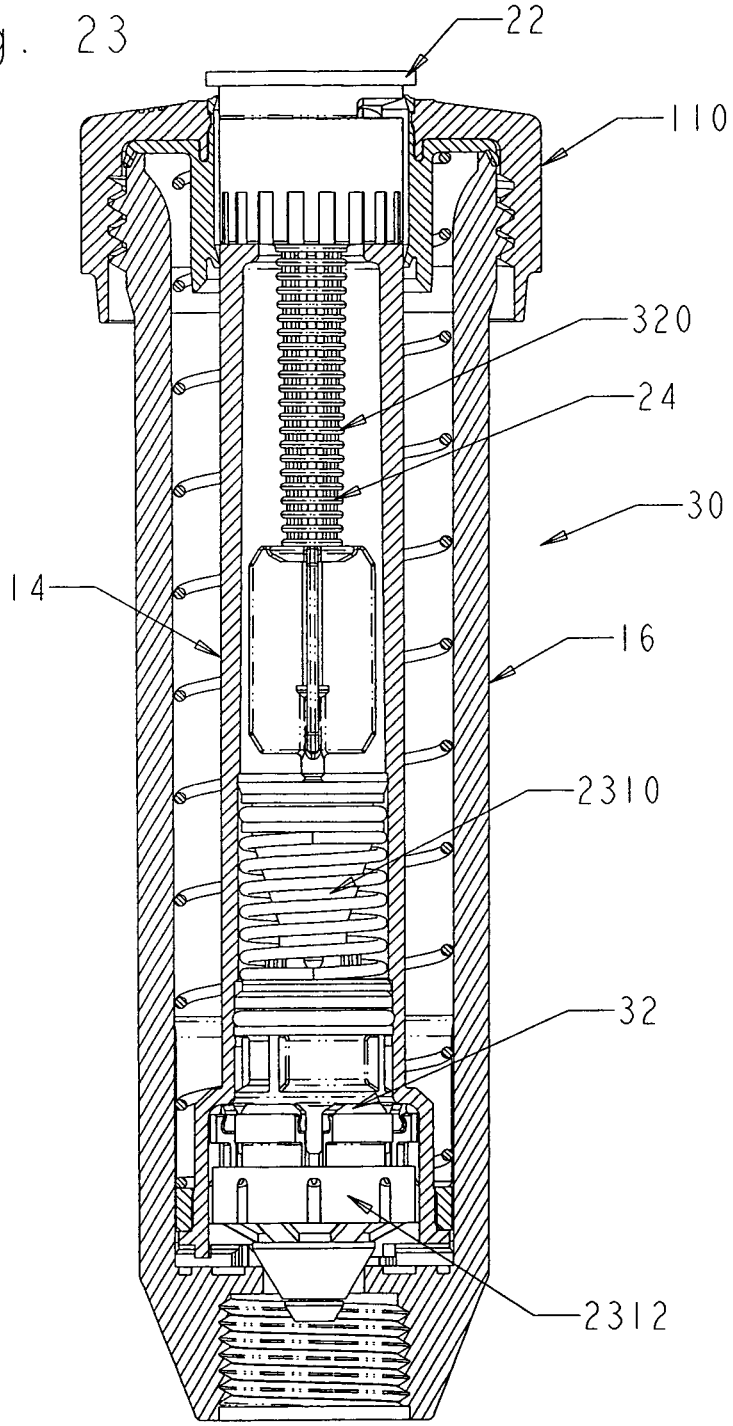
FIG. 23 is a partial cross sectional view showing the sprinkler device in a retraced position with a pressure regulator and an anti-drain valve installed.

FIG. 23 shows the sprinkler device 30 in which a known modular pressure regulator 2310 is installed. Further, a known modular anti-drain valve 2312 is installed at the lower end of the housing conduit 16. The modular flow stop mechanism 32 of this specification can be used in a sprinkler that also includes the modular pressure regulator 2310 and the modular anti-drain valve 2312 or one of the modular pressure regulator 2310 and the modular anti-drain valve 2312. That is, the flow stop mechanism 32 can be used with or without the pressure regulator 2310 and the anti-drain valve 2312. The pressure regulator 2310 optimizes the pressure at the nozzle 22, and the anti-drain valve prevents water draining from supply pipes from entering the sprinkler device 30 when the water supply is off. The flow stop mechanism 32 does not interfere with the operation of the pressure regulator 2310 and the anti-drain valve 2312 Likewise, the pressure regulator 2310 and the anti-drain valve 2312 do not interfere with the operation of the flow stop mechanism 32. The push rod 38 is sized to pass through the pressure regulator 2310, and the flow stop mechanism 32 is constructed to fit downstream of the anti-drain valve 2312.

All parts described herein, except for the spring 18, are preferably molded plastic.

Collectively, one or more push rods and the insert member form a valve opening device, which is loaded in compression by the force of the water pressure. When the valve opening device is damaged or severed, the valve 35 is closed by water pressure. In an alternative embodiment, the push rod 38 and the insert member 320 can be formed as an integrated unitary member. In other words, the valve opening device can be an integral unitary member instead of an assembled combination of the push rod 38 and the insert member 320.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

The invention claimed is:

1. A sprinkler device comprising:

a housing conduit, which has an upstream end and a downstream end, and includes an inlet at the upstream end;

an inner conduit fitted in the housing conduit in an axially movable manner so that the inner conduit moves axially to an extended position, at which the inner conduit projects from the housing conduit, when a predetermined level of water pressure is applied to the inlet;

a valve, disposed at an upstream end of the inner conduit and at a location that is proximal to the downstream end of the housing conduit when the inner conduit is in the extended position, including a valve body, a housing member, a chamber, and a movable valve member, the chamber being enclosed by the valve body and the housing member, and the movable valve member being disposed in the chamber; and a valve opening device located within the inner conduit downstream of the valve to operate the valve, wherein a rounded annular projection is formed on an inner surface of the inner conduit, the annular projection resisting downward axial movement of the valve body and retaining the valve body in the upstream end of the inner conduit, when the movable valve member is in an upstream position in the chamber, the valve opens and water can flow through the chamber to the inner conduit, when the movable valve member is in a downstream position in the chamber, the valve closes and water is blocked from flowing through the chamber, a force of water pressure from the inlet tends to move the movable valve member downstream in the chamber so as to close the valve in the chamber, an upstream end of the valve opening device engages the movable valve member of the valve, so that an axial force applied by the valve opening device toward the valve opposes the force of water pressure that tends to move the movable valve member downstream in the chamber and close the valve, the length of the valve opening device is predetermined in relation to the length of the inner conduit so that the valve opening device normally holds the movable valve member in the upstream position in the chamber so as to keep the valve open, the housing member includes a plurality of openings, into which water flows when the valve is open, and if the valve opening device is severed, water pressure from the inlet will force the movable valve member downstream in the chamber thereby closing the valve.

2. The sprinkler device according to claim 1, wherein the valve opening device includes an insert member and a push rod, which are separate from one another, and a downstream end of the push rod engages an upstream end of the insert member.

3. The sprinkler device according to claim 2, wherein the push rod includes a plurality of vanes, which are aligned with a flow direction of water in the sprinkler device.

4. The sprinkler device according to claim 2, wherein the push rod includes a cylindrical section in which a reduced diameter area is formed, the reduced diameter area providing a weakness in the cylindrical section thereby facilitating breakage of the push rod when force is applied to the push rod.

5. The sprinkler device according to claim 2, wherein a neck is formed at an upstream end of the push rod, and a downstream end of the movable valve member includes a socket for receiving the neck at the upstream end of the push rod, and the upstream end of the push rod and the downstream end of the movable valve member form a releasable coupling for retaining the push rod and the movable valve member together.

6. The sprinkler device according to claim 2, wherein the housing member is snap-fitted to the valve body to thereby form the exterior of the valve.

7. The sprinkler device according to claim 2, wherein an upstream end of the push rod and a downstream end of the movable valve member form a releasable coupling for retaining the push rod and the movable valve member together.

8. The sprinkler device according to claim 2, wherein the releasable coupling is a snap-fit coupling.

9. The sprinkler device according to claim 2, wherein the insert member is one of a flush cap insert and a filter element.

10. The sprinkler device according to claim 2, wherein the push rod is of variable length according to the length of the inner conduit.

11. The sprinkler device according to claim 1, wherein the valve opening device includes an insert member and a push rod that are integrally formed as a unitary member, a downstream end of the push rod engaging an upstream end of the insert member.

12. The sprinkler device according to claim 1, wherein the valve opening device includes a plurality of push rods interconnected in series, an actual number of which varies according to the length of the inner conduit.

13. The sprinkler device according to claim 12, wherein a downstream end of at least one of the plurality of push rods engages an upstream end of an insert member, and an upstream end of a different one of the plurality of push rods and a downstream end of the movable valve member form a releasable coupling for retaining the plurality of push rods and the movable valve member together.

14. The sprinkler device according to claim 13, wherein the releasable coupling is a snap-fit coupling.

15. The sprinkler device according to claim 13, wherein the plurality of vanes are angularly spaced apart from each by ninety degree intervals.

16. The sprinkler device according to claim 1, wherein when the inner conduit is in the extended position, the valve body remains below ground.

17. The sprinkler device according to claim 1, wherein the valve body includes a shoulder that abuts against a stepped surface of the inner conduit, the shoulder preventing upward axial movement of the valve body.

18. A sprinkler device comprising:

a housing conduit, which has an upstream end and a downstream end, and includes an inlet at the upstream end;

an inner conduit fitted in the housing conduit in an axially movable manner so that the inner conduit moves axially to an extended position, at which the inner conduit projects from the housing conduit, when a predetermined level of water pressure is applied to the inlet;

a valve, disposed at an upstream end of the inner conduit and at a location that is proximal to the downstream end of the housing conduit when the inner conduit is in the extended position, including a valve body, a housing member, a chamber, and a movable valve member, the chamber being enclosed by the valve body and the housing member, and the movable valve member being disposed in the chamber; and a valve opening device located within the inner conduit downstream of the valve to operate the valve, wherein when the movable valve member is in an upstream position in the chamber, the valve opens and water can flow through the chamber to the inner conduit, when the movable valve member is in a downstream position in the chamber, the valve closes and water is blocked from flowing through the chamber, a force of water pressure from the inlet tends to move the movable valve member downstream in the chamber so as to close the valve in the chamber, an upstream end of the valve opening device engages the movable valve member of the valve, so that an axial force applied by the valve opening device toward the valve opposes the force of water pressure that tends to move the movable valve member downstream in the chamber and close the valve, the length of the valve opening device is predetermined in relation to the length of the inner conduit so that the valve opening device normally holds the movable valve member in the upstream position in the chamber so as to keep the valve open, the housing member includes a plurality of openings, into which water flows when the valve is open, if the valve opening device is severed, water pressure from the inlet will force the movable valve member downstream in the chamber thereby closing the valve, and the movable valve member includes a lower extension that fits in a cylindrical guide formed in the housing member, the lower extension and the cylindrical guide operating so that movable valve member is aligned with a center axis of the housing member and is centered with respect to the inner conduit.

19. A sprinkler device comprising:

a housing conduit, which has an upstream end and a downstream end, and includes an inlet at the upstream end;

an inner conduit fitted in the housing conduit in an axially movable manner so that the inner conduit moves axially to an extended position, at which the inner conduit projects from the housing conduit, when a predetermined level of water pressure is applied to the inlet;

a spring retainer, formed around the upstream end of the inner conduit, that includes surface channels that accommodate ribs formed on an inner surface of the housing conduit, an inner surface of the spring retainer and an outer surface of the inner conduit having an interference fit that allows rotational adjustment of the inner conduit about the longitudinal axis of the sprinkler device;

a valve, disposed at an upstream end of the inner conduit and at a location that is proximal to the downstream end of the housing conduit when the inner conduit is in the extended position, including a valve body, a housing member, a chamber, and a movable valve member, the chamber being enclosed by the valve body and the housing member, and the movable valve member being disposed in the chamber; and a valve opening device located within the inner conduit downstream of the valve to operate the valve, wherein when the movable valve member is in an upstream position in the chamber, the valve opens and water can flow through the chamber to the inner conduit, when the movable valve member is in a downstream position in the chamber, the valve closes and water is blocked from flowing through the chamber, a force of water pressure from the inlet tends to move the movable valve member downstream in the chamber so as to close the valve in the chamber, an upstream end of the valve opening device engages the movable valve member of the valve, so that an axial force applied by the valve opening device toward the valve opposes the force of water pressure that tends to move the movable valve member downstream in the chamber and close the valve, the length of the valve opening device is predetermined in relation to the length of the inner conduit so that the valve opening device normally holds the movable valve member in the upstream position in the chamber so as to keep the valve open, the housing member includes a plurality of openings, into which water flows when the valve is open, if the valve opening device is severed, water pressure from the inlet will force the movable valve member downstream in the chamber thereby closing the valve.

* * * * *